United States Patent [19]

Yamasaki et al.

[11] 4,215,972

[45] Aug. 5, 1980

[54] TRANSFER MECHANISM EMPLOYING SWINGABLE ARM FORMED AS A PARALLELOGRAM LINKAGE

[75] Inventors: Akitoshi Yamasaki, Takatsuki; Kajunori Miyauchi, Neyagawa, both of Japan

[73] Assignee: Tsubakimoto Chain Co., Osaka, Japan

[21] Appl. No.: 911,497

[22] Filed: Jun. 1, 1978

[51] Int. Cl.[2] ..... B66C 23/04

[52] U.S. Cl. ..... 414/742; 414/749; 414/917; 414/719; 212/196; 212/197

[58] Field of Search ..... 414/742, 749, 719, 917; 212/48, 49

[56] References Cited

U.S. PATENT DOCUMENTS

| | | | |
|---|---|---|---|
| 2,131,133 | 9/1938 | Babson | 212/49 |
| 3,850,307 | 11/1974 | Motoda | 414/917 |
| 3,995,746 | 12/1976 | Usagida | 414/917 |
| 3,995,756 | 12/1976 | Hjelm | 414/917 |

FOREIGN PATENT DOCUMENTS

| | | | |
|---|---|---|---|
| 2416972 | 1/1975 | Fed. Rep. of Germany | 212/48 |
| 752129 | 7/1956 | United Kingdom | 212/48 |
| 153781 | 7/1963 | U.S.S.R. | 212/48 |

*Primary Examiner*—Stephen G. Kunin
*Assistant Examiner*—Lawrence E. Williams
*Attorney, Agent, or Firm*—Blanchard, Flynn, Thiel, Boutell & Tanis

[57] ABSTRACT

A transfer apparatus comprising an object-suspending rod, upper and lower support rods whose one ends are pivotally connected to the object-suspending rod, and a connecting rod pivotally connecting the other ends of the support rods. The object-suspending rod, the connecting rod and the upper and lower support rods are disposed in parallel to constitute two pairs of opposite sides of a parallelogram link mechanism. An object hanger is attached to the lower end of the object-suspending rod. The other end of the upper support rod is connected to a balance weight which is guided in a vertical guide slot in a suspended support member so as to be movable up and down by a fluid cylinder device. The lower-support rod and connecting rod are connected by a pivot shaft which is movably guided in a horizontal guide slot in the support member. Another balance weight is connected to the other end of the lower-support rod.

12 Claims, 4 Drawing Figures

TRANSFER MECHANISM EMPLOYING SWINGABLE ARM FORMED AS A PARALLELOGRAM LINKAGE

FIELD OF THE INVENTION

This invention relates to transfer apparatus that is capable of not only moving an object to be transferred up and down and rotating it in a horizontal plane, but also rotating it in a vertical plane that includes or is parallel with the axis of said horizontal rotation.

BACKGROUND OF THE INVENTION

Conventional transfer apparatus have a transfer arm, as defined by an object-supporting rod connected with a link mechanism, which horizontally rotates about a support member to support the transfer arm and which moves up and down, or, in addition, moves back and forth diametrically about said support member. The transfer arm cannot rotate across the axis of the support member or in a vertical plane that includes said axis. When transferring an object from the left side of the support member to the right side thereof, the transfer arm must be rotated about the support member. Therefore, the transfer from the left to the right becomes impossible if there is any obstacle in the way in which the object rotates.

Further, it is desired that the unloaded transfer arm be kept in a substantially balanced condition wherever it moves. With conventional transfer arms, however, it has been difficult to stabilize the balanced moments thereof in accordance with changes in the arms' position because they have only one balance weight.

This invention has eliminated the above-described shortcomings of the conventional apparatus, as described hereunder by reference to the accompanying drawings.

SUMMARY OF THE INVENTION

Figure 1:
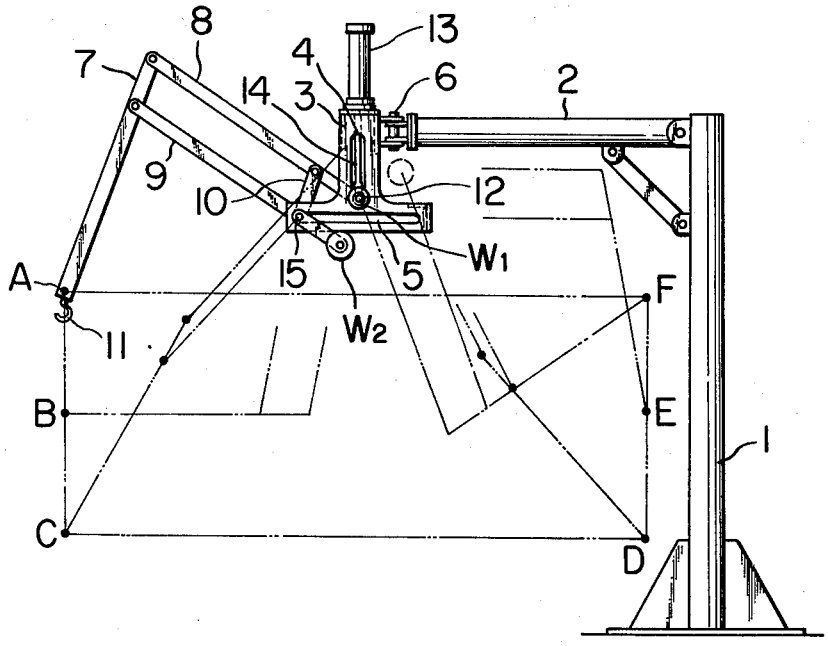
FIG. 1 is a front view of an embodiment of this invention.

The transfer apparatus of this invention comprises an object-suspending rod, upper and lower support rods whose one ends are pivotally connected to said object-suspending rod and a connecting rod pivotally connecting the other ends of said support rods, said object-suspending rod and said connecting rod as well as said upper and lower support rods being disposed in parallel to constitute two pairs of opposite sides of a vertically positioned parallelogram link mechanism. An object hanger is attached to the lowest end of said object-suspending rod. The other end of said upper support rod is connected to a balance weight which is guided in a vertical guide slot in a suspended support member so as to be movable up and down by a fluid cylinder device. A pivot shaft connects the lower-support and connecting rods, the pivot shaft being movably guided in a horizontal guide slot in said support member, and another balance weight is connected to the other end of said lower-support rod. These weights substantially balance the transfer arm in substantially any position of use. The link mechanism enables the hanger to be raised and lowered, and swingably moved within a vertical plane. The support member, and the transfer arm mounted thereon, can also be horizontally rotated as a unit about a vertical axis.

DETAILED DESCRIPTION

In the drawings, a support member 3 suspended from an arm 2 of a pole 1 has a vertical guide slot 4 and a horizontal guide slot 5. The support member 3 may also be horizontally rotatably connected to one end of the arm 2 by a vertical hinge pin 6 as illustrated.

An object-suspending rod 7, an upper-support rod 8 and a lower-support rod 9, each of which is pivotally connected to said rod 7 at one end, and a connecting rod 10 pivotally connecting said support rods 8 and 9 adjacent the other ends thereof, make up a transfer arm. This transfer arm forms a parallelogram link mechanism, with the suspending rod 7 and the connecting rod 10 constituting a pair of opposite parallel sides and the upper and lower support rods 8 and 9 the other pair of parellel sides. An object hanger 11 is attached to the lowest end of the suspending rod 7. The other end 12 of the upper-support rod 8 is attached to a balance weight $W_1$ which is guided in said vertical guide slot 4 so as to be movable up and down therealong. The weight $W_1$ is raised and lowered by a piston rod 14 of a fluid cylinder device 13 mounted on the support member 3. The other end 15 of the lower-support rod 9, at its pivotal connection 15 to the rod 10, is movably inserted in said horizontal guide slot 5 and has attached thereto a balance weight $W_2$ spaced outwardly from said connection 15.

The weights $W_1$ and $W_2$ balance the weight of the unloaded transfer arm itself. Thrust P of the double-acting fluid cylinder device 13 imparts such force to the transfer arm that it raises and lowers an object to be transferred, which object is engaged with the hanger 11, and holds the loaded transfer arm in a balanced condition.

Figure 2:
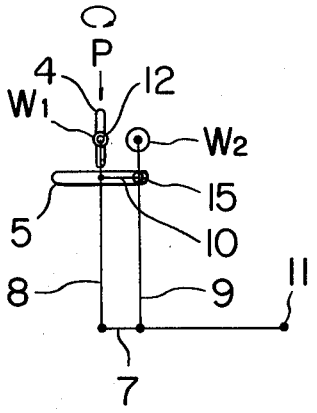
FIGS. 2 and 3 illustrate the balance between the transfer rod and the balance weights.
Figure 3:
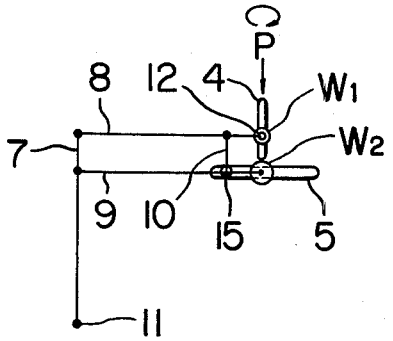

When the transfer arm is in an unloaded condition and is positioned as shown in FIG. 2, the opposed moments on opposite sides of the pivot 15 (which acts as a fulcrum), which moments are created by the weight of the transfer arm itself and the balance weight $W_1$, are substantially balanced. On the other hand, when the unloaded transfer arm is in the position shown in FIG. 3, the moments on opposite sides of the fulcrum 15 as created by the weight of the transfer rod itself and the balance weights $W_1$ and $W_2$, are substantially balanced.

Under a loaded condition, the moment created by the object hung on the arm and the moment created by the thrust P of the fluid cylinder device 13 balance one another on opposite sides of the pivot 15, which pivot serves as a fulcrum.

Whatever position or height the object hanger 11, loaded or unloaded, may move into, a balanced condition is always maintained because the ends or pins 12 and 15 are slidably guided along the guide slots 4 and 5, respectively.

Accordingly, the object hanger 11 can be moved from the position A shown by solid lines in FIG. 1 to any of desired positions B, C, D, E and F in a vertical plane that includes the vertical axis of the support member as defined by hinge pin 6, in which positions the transfer arm assumes locations as shown by dot-dash lines. Of course, it is also possible to move the transfer arm from the position shown in FIG. 2 to the position shown in FIG. 3.

As understood from the above, the transfer arm of this invention, when unloaded, is held in a balanced condition at any desired position and height, because the downward vertical moment created by the weight of the transfer arm itself (which moment is counterclockwise about pivot 15 as shown in FIG. 1) balances with the downward vertical moment created by the two balance weights (which moment is clockwise about pivot 15 as viewed in FIG. 1). When loaded, the thrust P from the pressure cylinder device 13 balances the load being carried by hanger 11 since the thrust and load are horizontally on opposite sides of the pivot 15. The thrust P can be selected by varying the pressure of the fluid supplied to the cylinder device so as to properly balance the magnitude of the load. Consequently, whether loaded or not, the transfer arm moves easily, assumes a desired position, and stays there in a balanced state.

Because the two ends of the transfer arm can freely move in and along the vertical and horizontal guide slots as the transfer arm moves, the object hanger 11 is capable of freely moving directly under the support member 3 from one side thereof to the other. If provision is made that the support member can move about the pin 6, horizontal rotation around the vertical pin becomes possible, in addition to said motion in the vertical plane.

Figure 4:
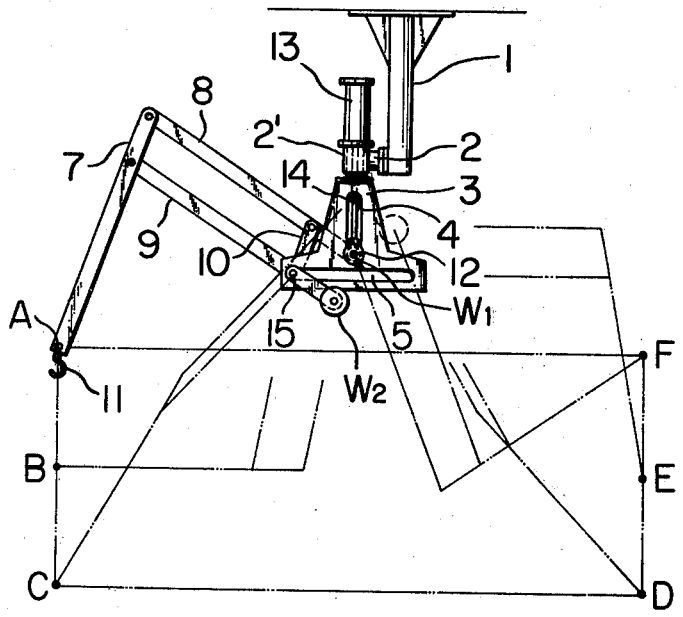
FIG. 4 is a front view showing a variation wherein the support member can rotate through 360 degrees about the axis of the cylinder device.

If the pole 1 connects to the support 3 or cylinder device 13 from above, as shown in FIG. 4, then the support member 3 can rotate through 360 degrees about the vertical axis of the cylinder device, thus expanding the functions and capabilities of the transfer apparatus. In this variation, the end of arm 2 is provided with a part 2', such as a journal bearing, which suspendingly supports the member 3 while permitting it, and the transfer arm mounted thereon, to horizontally rotate about the vertical axis defined by said part 2'.

The arrangement of the vertical and horizontal guide slots is not limited to the way they are disposed in the above-described embodiments. For instance, the vertical guide slot may be provided under the horizontal guide slot. This permits the object-suspending rod to move in a wider range than ever, both vertically and horizontally. The result is a great expansion of the range within which the transfer arm performs its transfer function. The object can be moved from one side of the support member to the other even in such a small space wherein the transfer arm cannot rotate.

What is claimed:

1. Transfer apparatus comprising an object-suspending rod, upper and lower support rods whose one ends are pivotally connected to said object-suspending rod, and a connecting rod pivotally connecting said support rods adjacent the other ends thereof, said object-suspending rod and said connecting rod as well as said upper and lower support rods being disposed in parallel to constitute two pairs of opposite sides of a parallelogram link mechanism, an object hanger attached to the lowest end of said object-suspending rod, a vertically stationary support member having substantially vertical and transverse guide slots therein, a fluid-pressure cylinder device stationary mounted relative to said support member and having an extendible and contractible portion, the other end of said upper support rod being connected to a balance weight which is movably guided in said vertical guide slot so as to be movable up and down therein by the extendible and contractible portion of said cylinder device, a pivot shaft connecting the lower-support and connecting rods, the pivot shaft functioning as a fulcrum for permitting swinging of said parallelogram link mechanism relative to said support member and being guided for movement along said transverse guide slot in said support member, and another balance weight connected to the other end of said lower-support rod in spaced relation from said pivot shaft.

2. A transfer apparatus according to claim 1, wherein said transverse guide slot extends approximately horizontally and extends continually across a vertically-extending line defined by the longitudinal direction of said vertical slot, whereby said transverse slot has elongated portions thereof positioned horizontally on opposite sides of said vertically-extending line.

3. A transfer apparatus for moving objects between selected locations, said apparatus comprising:

a support, and means for positioning said support in a vertically fixed and upwardly spaced relationship with respect to a floor or other surface therebelow, said support having first and second elongated guide means extending in substantially perpendicular relationship with respect to one another, said first and second guide means defining a substantially vertical plane;

transfer arm means movably mounted on said support for permitting raising and lowering of an object and for also permitting swinging movement of said object within a substantially vertical plane, said transfer arm means including a vertically disposed parallelogram linkage formed by four pivotally interconnected links, a first of said links at a preselected point thereon being slidably guidably engaged with said first guide means, and a second one of said links at a preselected point thereon being slidably guidably engaged with said second guide means, one of said preselected points functioning as a fulcrum for permitting vertical swinging of said arm means;

object-engaging means attached to said arm means at a location spaced from said fulcrum;

weight means connected to said arm means in spaced relationship from said fulcrum for counterbalancing said arm means; and force-applying means coacting between said support and said arm means for applying a selected force to said arm means at a point spaced from said fulcrum for counterbalancing the effect of an object carried by said engaging means.

4. A transfer apparatus according to claim 3, wherein said first and second links extend parallel to one another, said parallelogram linkage including a third said link pivotally connected between said first and second links adjacent one end thereof, and a fourth said link disposed parallel with said third link and pivotally connected between said first and second links more closely adjacent the other ends thereof, said object engaging means being connected to said linkage in the vicinity of said third link; and said weight means including a pair of separate counterbalance weights, one of said weights being rigidly connected to said linkage directly at the other of said preselected points so that said one weight is movable solely due to slidable engagement with the respective guide means, the other of said weights being rigidly connected to said linkage at a location spaced from both of said preselected points.

5. A transfer apparatus according to claim 4, wherein said other weight is connected to said linkage at a location spaced on the opposite side of said fulcrum from said object-engaging means.

6. A transfer apparatus according to claim 4, wherein said pair of weights are individually rigidly connected to said first and second links adjacent said other ends thereof, the one weight being rigidly attached to said first link directly at the preselected point thereon so as to be solely slidably guided by engagement with said first guide means, the other weight being spaced on the opposite side of said fulcrum from said object-engaging means, said preselected point as defining said fulcrum being spaced intermediate the ends of said second link.

7. A transfer apparatus according to claim 4, wherein said force-applying means is connected to said arm means substantially at the preselected point on said first link, said force-applying means causing application of a force to said arm means in a direction substantially parallel with the direction of movement along said first guide means.

8. A transfer apparatus according to claim 6, wherein said second guide means extends approximately horizontally and is positioned vertically below said first guide means so that said second guide means extends continually across an extension of a line defining the longitudinal direction of said first guide means, the preselected point as slidably engaged with said second guide means functioning as said fulcrum.

9. A transfer apparatus according to claim 3, wherein said second guide means extends approximately horizontally and is positioned vertically below said first guide means so that said second guide means extends continually across an extension of a line defining the longitudinal direction of said first guide means, the preselected point as slidably engaged with said second guide means functioning as said fulcrum, and said weight means including a pair of separate counterbalance weights, one of said weights being rigidly connected to said first link directly at the other of said preselected points so that said one weight is movable solely due to slidable engagement with the respective first guide means, the other of said weights being rigidly connected to said second link at a location thereon whereby said fulcrum is located intermediate said other weight and said point of connection between said second link and said object-engaging means.

10. A transfer apparatus for moving objects between selected locations, said apparatus comprising:

a support, and means for stationarily positioning said support relative to the vertical, said support having first and second elongated guide means extending in substantially transverse relationship with respect to one another, said first and second guide means defining a substantially vertical plane, and one of said guide means extending continually across a line defining the elongated direction of said other guide means;

transfer arm means movably mounted on said support for permitting raising and lowering of an object and for also permitting swinging movement of said object within a substantially vertical plane, said transfer arm means comprising a vertically disposed parallelogram linkage movably supported on said support;

said parallelogram linkage including first and second substantially parallel elongated links, and substantially parallel third and fourth links each extending transversely between said pivotally connected to said first and second links;

said third link being pivotally connected in spaced relationship to one end of each of said first and second links, said third link having object-engaging means associated therewith;

said fourth link being pivotally connected to each of said first and second links at a location spaced from said one end thereof;

said first link having a first preselected point thereon slidably and guidably engaged with said other guide means, said first preselected point being defined adjacent the other end of said first link;

said second link having a second preselected point thereon which is slidably and guidably engaged with said one guide means, said second preselected point being disposed intermediate the ends of said second link;

a first counterweight attached to said first link at said first preselected point, whereby said first counterweight is confined for slidable displacement in the longitudinal direction of said other guide means;

a second counterweight attached to said second link at a third preselected point located adjacent the other end thereof, said third preselected point being spaced from said second preselected point, whereby said second preselected point is disposed between said second counterweight and said third link; and force-applying means coacting between said support and said arm means for applying a selected force to said arm means at a point thereon which is spaced from one of said first and second preselected points for controlling the movement of said arm means and of the object carried thereby.

11. A transfer apparatus according to claim 10, including mounting means for rotationally supporting said support for rotational movement about a substantially vertical axis which is positioned in close proximity to and substantially parallel with the elongated direction of one of said first and second guide means.

12. A transfer apparatus according to claim 11, wherein said one guide means extends approximately horizontally and the other guide means extends approximately vertically, said horizontally-extending guide means being vertically spaced from said vertically extending guide means so as to not physically intersect same, and said force-applying means including a movable force-applying member connected to said first link at said first preselected point.

* * * * *

UNITED STATES PATENT AND TRADEMARK OFFICE

CERTIFICATE OF CORRECTION

PATENT NO. : 4,215,972

DATED : August 5, 1980

INVENTOR(S) : Akitoshi Yamasaki et al.

It is certified that error appears in the above—identified patent and that said Letters Patent is hereby corrected as shown below:

Column 5, line 17, "Claim 4" should be -- Claim 6 --.

Column 6, line 11, "said" should be -- and --.

Signed and Sealed this

*Fourth* Day of *November 1980*

[SEAL]

*Attest:*

SIDNEY A. DIAMOND

*Attesting Officer*

*Commissioner of Patents and Trademarks*